US006438911B1

(12) United States Patent
Gorman

(10) Patent No.: US 6,438,911 B1
(45) Date of Patent: Aug. 27, 2002

(54) SIZABLE BACK-UP SHEAR PLATE FOR METAL FRAME WINDOWS

(75) Inventor: Christopher A. Gorman, Ft. Lauderdale, FL (US)

(73) Assignee: Store Front Supplies, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/545,921

(22) Filed: Apr. 10, 2000

Related U.S. Application Data

(63) Continuation-in-part of application No. 09/351,395, filed on Jul. 13, 1999, and a continuation-in-part of application No. 09/321,025, filed on May 27, 1999.

(51) Int. Cl.[7] ..... E06B 7/00

(52) U.S. Cl. ..... 52/204.595; 52/204.1; 52/204.54; 52/204.597; 52/204.69; 52/205; 52/213; 52/239; 52/773

(58) Field of Search ..... 52/204.54, 204.595, 52/204.69, 204.597, 239, 213, 205, 773, 204.1

(56) References Cited

U.S. PATENT DOCUMENTS

| | | | | |
|---|---|---|---|---|
| 3,869,839 A | | 3/1975 | Johnson et al. | 52/204 |
| 4,068,432 A | * | 1/1978 | Davis | 52/205 |
| 6,088,979 A | * | 7/2000 | Neal | 52/212 |

* cited by examiner

*Primary Examiner*—Carl D. Friedman
*Assistant Examiner*—Christy M. Green

(74) *Attorney, Agent, or Firm*—Fleit, Kain; Robert C. Kain, Jr.

(57) ABSTRACT

The sizable plastic back-up shear plate is laterally disposed with generally a spring fit into the outwardly facing mouth of a metal window frame. For windows having smaller mouths, the shear plate is cut along a discardable edge portion. The outwardly facing mouth is formed and defined by the window frame elongated hollow body and particularly by outer wall elements which face each other in an opposing manner. The plastic back-up shear plate has laterally disposed opposite outer edge portions which are interlockable on corresponding outer wall elements of hollow body metal window frame which wall elements define the mouth of the window frame. An intermediately disposed locking lip is utilized on smaller frame mouth after cutting or separating off the bread away edge portion. The plastic back-up shear plate has a lateral dimension slightly larger than the lateral mouth dimension and thereby achieves a spring fit. In one embodiment, the plastic back-up shear plate includes support ribs on its inner base plate face. In another embodiment or a further enhancement of the invention, the outer base face of the plastic back-up shear plate includes at least one, and preferably two, shim elements which rise above the flat outer base face out of the base plane of the plastic back-up shear plate. The shim elements may be configured as arcuate elements spanning a reasonable portion of the flat outer base face. In another refined embodiment, compressible shim elements are fingers having a proximal joint supported on the outer base face and a finger body rising above the outer base face. These finger shims may further include finger pads on distal ends opposite the base joints. The finger bodies may arcuately define a concave form with the outer base face. The finger pads may have a convex arcuate shape as compared to the concaved shaped finger bodies. The shear plate may be constructed to accommodate one of two frames.

15 Claims, 7 Drawing Sheets

SIZABLE BACK-UP SHEAR PLATE FOR METAL FRAME WINDOWS

This is a continuation-in-part of U.S. patent application Ser. No. 09/351,395 filed Jul. 13, 1999, and a continuation-in-part of U.S. patent application Ser. No. 09/321,025, filed May 27, 1999, which are both currently pending.

The present invention relates to a back-up shear plate for metal frame windows.

BACKGROUND OF THE INVENTION

Metal frame windows usually include vertically and horizontally oriented elongated hollow bodies with inwardly disposed wall elements (in a direction towards the glass window pane), front and rear wall elements (which may be exterior and interior faces, respectively) and outer wall elements. The outer wall elements are opposite the inwardly disposed wall elements. The inwardly disposed wall elements form an inwardly facing U-shaped or C-shaped channel adapted to retain a window pane therein. The window pane is placed in the U-shaped or C-shaped channel with a gasket, caulk or other type of sealant placed along the front and rear intersecting joints between the U-shaped channel of the metal window frame and the glass pane.

The metal window frame elements, which are the aforementioned elongated hollow bodies, surround the periphery of the window pane. Although reference herein is made to a singular window frame elongated hollow body, the back-up shear plate described herein is used at predetermined locations on each of the horizontal window frame members and vertical window frame members. Typically, back-up shear plates are placed four inches from each comer of the metal window frame and nine inches from the mid-point of each window frame run, that is, nine inches on either side of the center point of the upper and lower horizontal window frame elements and the left and right vertical window frame elements.

Back-up shear plates are customarily made of aluminum. The aluminum shear plate is extruded to form a base plate having laterally disposed interlockable members (generally female edge members) which interact with the opposing lateral wall elements forming the outwardly facing mouth of the elongated window frame hollow body. The prior art aluminum shear plates are cut in approximately four inch lengths (the longitudinal aspect of the plate) and then placed on a window frame element to cover select portions of the outwardly facing mouth of the metal window frame elongated hollow body member. Prior art aluminum back-up shear plates have a tendency to slide in the mouth of the hollow body frame. Accordingly, installers of windows were required to manually crimp at least two and typically four comers of the aluminum back-up shear plate. Further, prior art aluminum shear plates require two sets of drill bits. The first drill bit is used to drill through the aluminum back-up plate and the second drill bit is used to create a hole for the masonry screw which mounts the metal frame to a concrete column.

Also, prior art aluminum back-up shear plates do not include any self shimming elements. As known in the window installation business, after the rough opening of the window is measured, the metal window frame is constructed from extruded aluminum frame elements and then is installed in the rough opening using back-up shear plates and a plurality of shims. The shims may be wood or other types of readily available construction material. The shims are utilized to level and plum the window in the rough opening and to secure the window in the frame from shear forces. The back-up shear plates are mounted with masonry screws extending through the metal window frames, the back-up shear plates and into the vertical columns and horizontal header and footer to prevent the metal window frame from moving in the rough opening. Shear is an action or stress resulting from applied forces that cause or tend to cause two contiguous parts to slide relative to each other in a direction parallel to their plane of contact.

The present invention solves the problem of utilizing two drill bits, crimping the aluminum back-up shear plate, and, in some instances, provides self shimming structures for the window frame.

OBJECTS OF THE INVENTION

It is an object of the present invention to provide a plastic back-up shear plate for metal window frames.

It is an additional object of the present invention to provide an intermediate locking lip inboard of a break-away edge portion to permit conversion of the shear plate from a larger window frame mouth to a smaller window frame mouth.

It is another object of the present invention to provide a back-up shear plate which includes self shimming elements.

It is a further object of the present invention to provide a plastic back-up shear plate which includes support ribs for the window pane channel.

It is a further object of the present invention to provide a back-up shear plate which is spring fit into the outwardly facing mouth of the metal window frame in order to avoid further manipulation (crimping) of the shear plate in the metal window frame.

It is a further object of the present invention to provide a unique shear plate design to enable use with metal window frames, manufactured by two different manufactures, having different critical dimensions.

SUMMARY OF THE INVENTION

The sizable plastic back-up shear plate is laterally disposed with generally a spring fit into the outwardly facing mouth of a metal window frame. For windows having smaller mouths, the shear plate is cut along a discardable edge portion. The outwardly facing mouth is formed and defined by the window frame elongated hollow body and particularly by outer wall elements which face each other in an opposing manner. The plastic back-up shear plate has laterally disposed opposite outer edge portions which are interlockable on corresponding outer wall elements of hollow body metal window frame which wall elements define the mouth of the window frame. An intermediately disposed locking lip is utilized on a smaller frame mouth after cutting or separating off the break-away edge portion. The plastic back-up shear plate has lateral lip to lock member dimensions slightly larger than the respective lateral mouth dimensions of the different sized frames to achieve a spring fit. In one embodiment, the plastic back-up shear plate includes support ribs on its inner base plate face. In another embodiment or a further enhancement of the invention, the outer base face of the plastic back-up shear plate includes at least one, and preferably two, shim elements which rise above the flat outer base face out of the base plane of the plastic back-up shear plate. The shim elements may be configured as arcuate elements spanning a reasonable portion of the flat outer base face. In another refined embodiment, compressible shim elements are fingers having a proximal joint supported on the outer base face and a finger body rising above the outer base face. These finger shims may further include finger pads on distal ends opposite the base joints. The finger bodies may arcuately define a concave form with the outer base face. The finger pads may have a convex arcuate shape as compared to the concaved shaped finger bodies. In a still further refinement, the shear plate is constructed and arranged to fit, with appropriate change in orientation, window frames of two different mouth openings.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a plastic back-up shear for a metal window frame.

Figure 1:
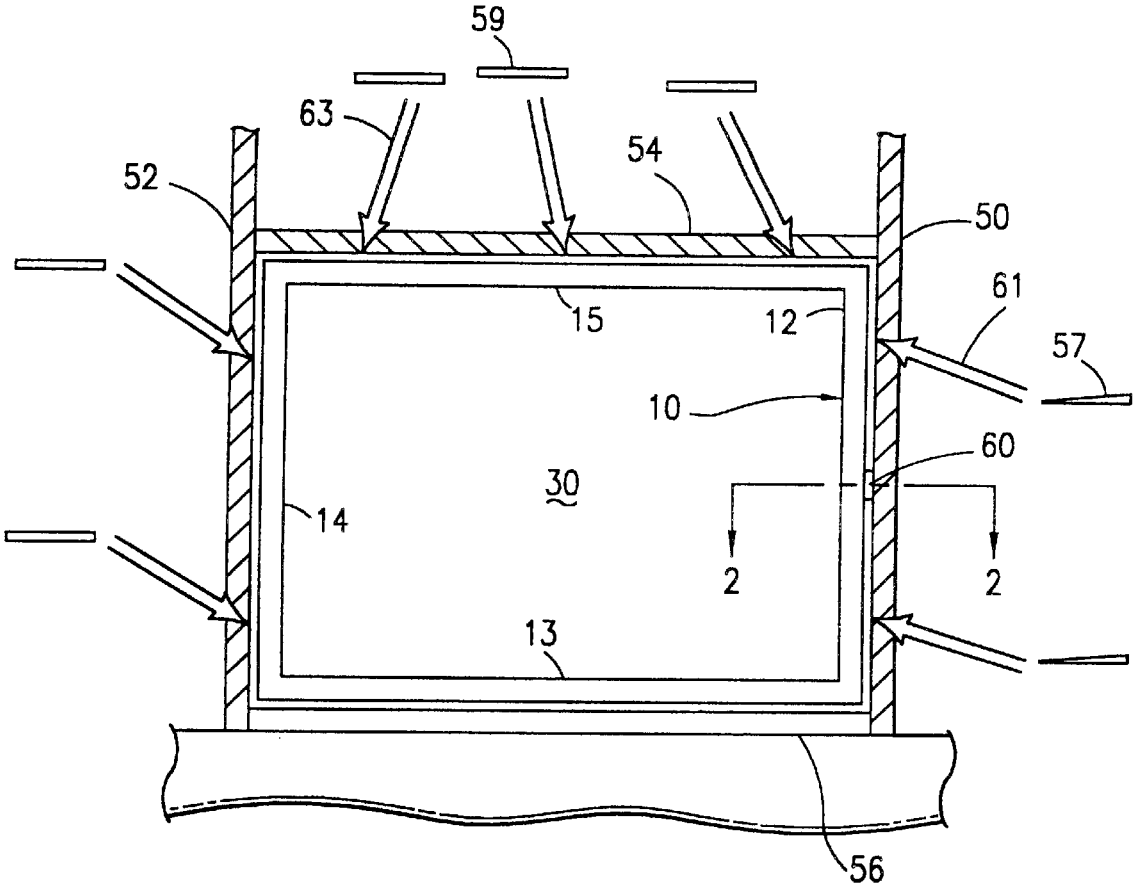
FIG. 1 diagrammatically illustrates a metal window frame (with or without a window pane) mounted in a rough opening of a building or other type of structure.
Figure 2:
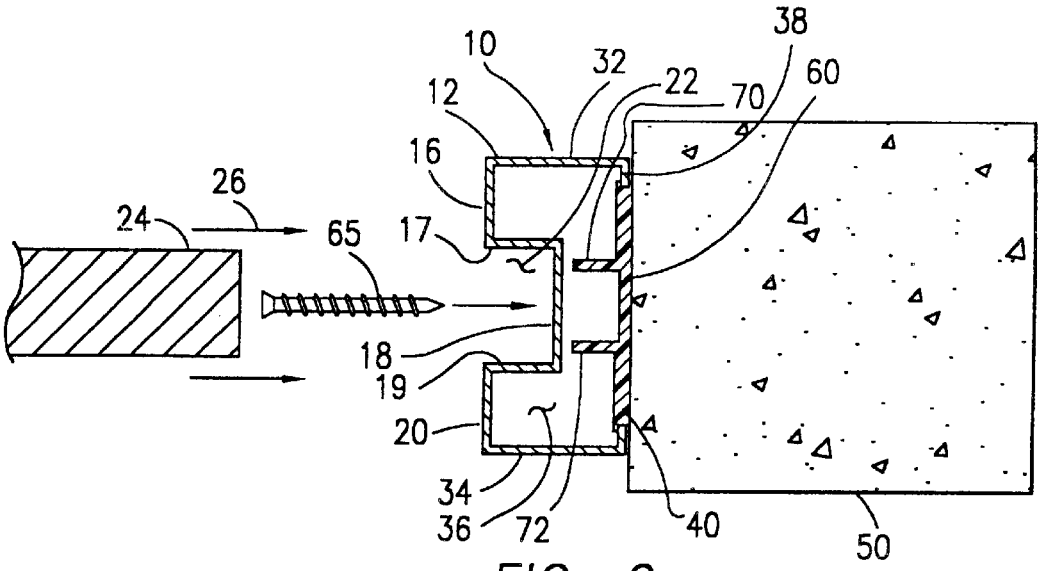
FIG. 2 diagrammatically illustrates one embodiment of the plastic back-up shear plate utilized in connection with the metal window frame in accordance with the principles of the present invention.

FIG. 1 diagrammatically illustrates metal window frame 10 having frame elements 12, 13, 14 and 15. In may instances, frame 10 is aluminum. All of the window frame elements 12–15 have generally the same elemental structure. Reference will be made concurrently to FIGS. 1 and 2 herein. FIG. 2 diagrammatically illustrates a cross-section of window frame 10 and specifically vertical window frame element 12 from the perspective of section line 2'–2" in FIG. 1. Each metal window frame 12, 13, 14, and 15 is an elongated hollow body having inwardly disposed wall elements 16, 17, 18, 19 and 20. Inwardly disposed wall elements 17, 18 and 19 form an inwardly facing U-shaped or C-shaped channel 22. A glass window pane 24 is placed in U-shaped channel 22 as shown by arrows 26 in FIG. 2. The direction inwardly refers to a direction toward central region 30 of pane 24 and is shown as the mid-point of the window in FIG. 1. In a similar manner, the term outer or outwardly refers to a direction opposite the central pane region 30.

Figure 3:
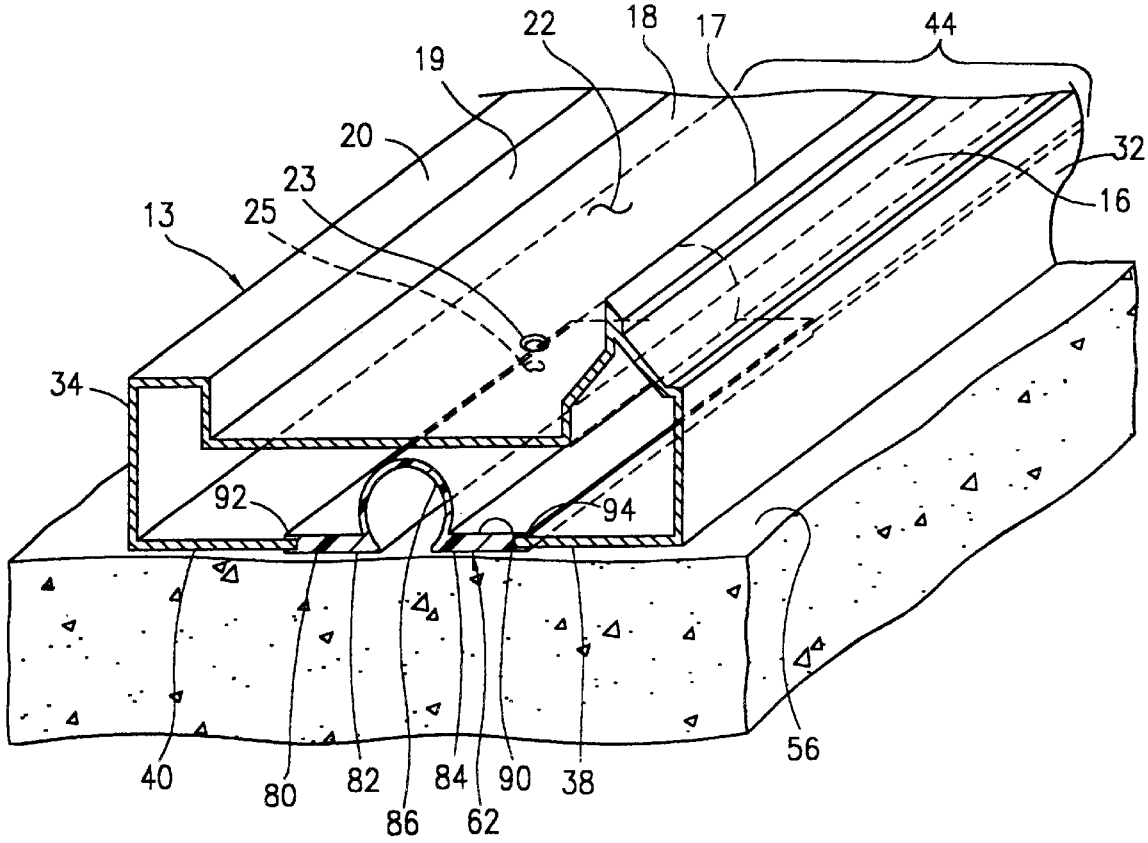
FIG. 3 diagrammatically illustrates another embodiment of the plastic back-up shear plate in accordance with the principles of the present invention wherein the plastic shear plate is mounted beneath a metal window frame adjacent a footer beam.

Metal window frame element 12 also includes a front wall element 32 and the rear wall element 34. The metal window frame is generally hollow as shown by cavity 36 in FIG. 2. The metal window frame 12 also includes outer wall elements 38, 40 which face toward each other and form an outwardly facing mouth. Mouth 44 is best illustrated in FIG. 3. Similar numerals designate similar items throughout all the drawings.

In order to mount metal window frame 10 in the rough opening established by vertical columns 50, 52 and header 54 and footer 56, the plastic back-up shear plate 60 is mounted at various locations on frame elements 12, 13, 14 and 15. The metal window frame 10 with the snap fit shear plate 60 is placed in the rough opening, the frame is plumed and leveled via a plurality of shims, two of which are identified as shims 57, 59 along the horizontal and vertical frame elements. FIG. 1 diagrammatically illustrates via arrows 61, 63 where shims 57, 59 may be placed in order to plum and level window frame 10 in the rough opening formed by columns 50, 52 and header 54 and footer 56. Either before, during or after the shimming operation, frame 10 and particularly window frame element 12 is drilled such that a hole is drilled through plastic back-up shear plate 60 and into column 50. Sometimes, column 50 is concrete and therefore a masonry drill bit is utilized to drill the support hole. A masonry drill bit can easily drill through the plastic back-up shear plate 60 made in accordance with the principles of the present invention.

Prior art aluminum back-up shear plates require a soft metal or a wood drill bit. A masonry drill bit cannot effectively drill through the aluminum back-up shear plate. However, a masonry drill bit is required to provide a lead hole for masonry screw 65.

Masonry screw 65 (FIG. 2) extends through U-shaped channel 22 and particularly inwardly disposed wall element 18, through a central region of plastic back-up shear plate 60 and into concrete column 50. Back-up shear plate 60 in addition to shims 57, 59 supports the metal window frame and also the glass window in the building or other structure.

Various features of plastic back-up shear plate 60 and other embodiments of shear plate 60 are discussed later in connection with FIGS. 3–15. However, in FIG. 2, the illustrated plastic back-up shear plate 60 includes an underlying support structure for the U-shaped channel 22. In this embodiment, the underlying support structure is a pair of upstanding ribs 70, 72 which restrict the outward movement of wall element 18 of U-shaped channel 22 due to insertion of screw 65.

FIG. 3 shows a broken away, perspective view of metal window frame element 13, plastic back-up shear plate 62 and footer 56.

Plastic back-up shear plate 62 includes a laterally disposed base plate 80 having, in this illustrated embodiment, base plate legs 92, 84 and an underlying support structure which is a generally a semi-circular tubular member 86. Support structure configured as tubular member 86 underlies and is immediately below U-shaped channel 22 of metal window frame element 13. In some instances, metal window frame 13 is pre-drilled to include a screw hole 23. In the illustrated embodiment, plastic back-up shear plate 62 has been drilled by the window installer to have a complementary screw hole 25.

The inner base plate face 90 formed by base plate 80, supports the support structure semi-circular tubular member 86. Laterally disposed opposite outer edge portions 92, 94 are interlockable on corresponding outer wall elements 38, 40 which define mouth 44 of metal window frame 13.

Figure 4:
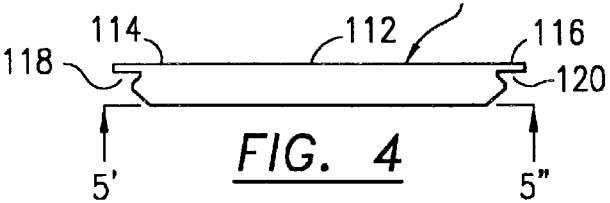
FIGS. 4 and 5 diagrammatically illustrate a side view and a top view of the inner base plate face of one embodiment of the back-up shear plate in accordance with the principles of the present invention.

FIG. 4 diagrammatically illustrates a cross-sectional view or an end view of back-up shear plate 110. Back-up shear plate 110 includes a base plate 112 having laterally disposed opposite outer edge portions 114, 116 with interlocking complementary cavities 118, 120 which interlock onto outer wall elements 38, 40 of the metal window frame. Plastic back-up shear plate 110 has a flat outer base face 112 and a generally flat inner back plate face 122. This is shown in FIG. 5.

Figure 5:
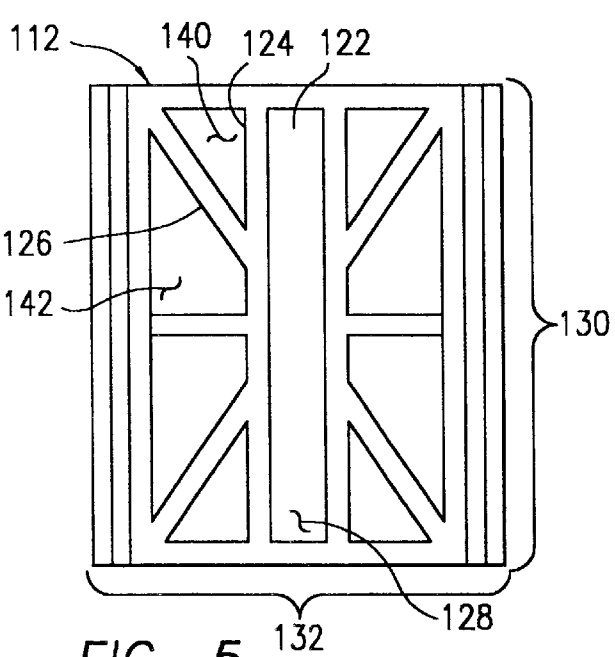

FIG. 5 also shows support ribs, two of which are identified as support ribs 124 and 126. Support ribs rise above inner back plate face 122 except for a longitudinal central run 128 running through a centrally located longitudinal region 130 of shear plate 112. The lateral dimension 132 is slightly larger than the lateral dimension of window frame mouth 44 (FIG. 3). Accordingly, the shear plate of the present invention is tightly interfit into the mouth of the metal window frame. This tight interfit or spring fit reduces or eliminates the possibility that the plastic shear plate will move relative to the metal window frame after it is placed in the mouth. Typically, the longitudinal extent 130 of the shear plate is 2–4 inches. Accordingly, the back-up shear plate occupies a small portion of the entire run of the metal window frame element.

In FIG. 5, support ribs 124, 126 form several geometric patterns which include a triangular geometric pattern in region 140 and a polygonal pattern in region 142. Of course, polygonal pattern 142 may be square, rectangular or other type of geometric pattern. Support ribs 124 and 126 provide additional strength to the plastic back-up shear plate 112. The clear longitudinal central run 128 on the inner back plate face 122 permits the masonry drill bit to easily pass through the central region. It should be noted that if the metal window frame element 13 is pre-drilled as shown by hole 23, it is relatively easy to place the plastic back-up shear plate 62, 112, in the appropriate location. However, the plastic back-up shear plate 62, 112, must be drilled with a masonry bit and that same drill bit is utilized to drill the pilot or screw hole in the concrete column, footer or header.

Figure 6:
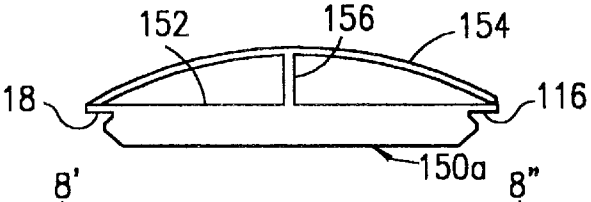
FIGS. 6 and 7 diagrammatically illustrate cross-sectional or end views of the plastic back-up shear plate having arcuate compressible shim members.
Figure 7:
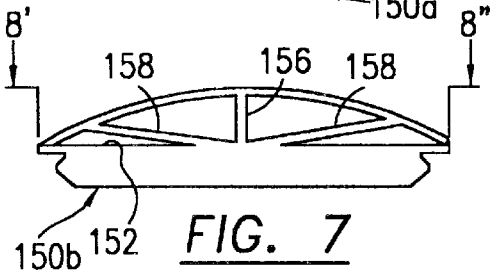
Figure 9:
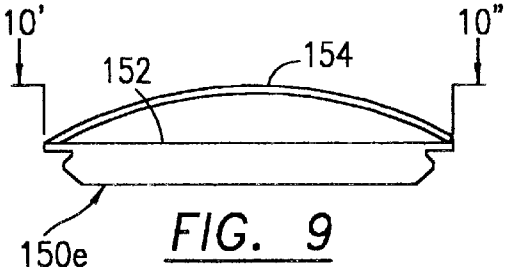
FIGS. 9 and 10 diagrammatically illustrate another arcuate compressible shim and the location of the pair of compressible shims on the outer base face of the plastic back-up shear plate in accordance with the principles of the present invention.
Figure 10:
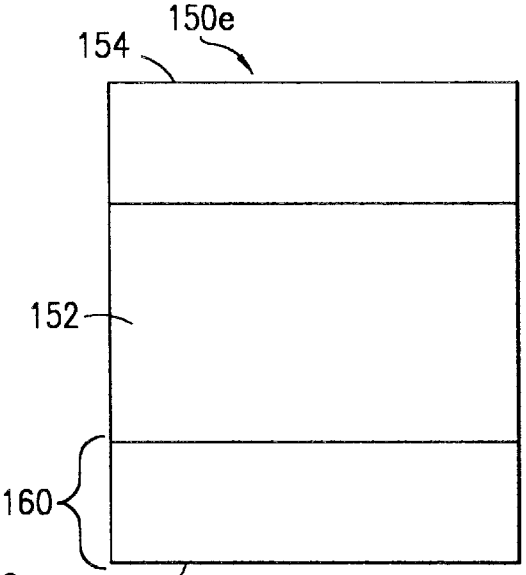
Figure 8:
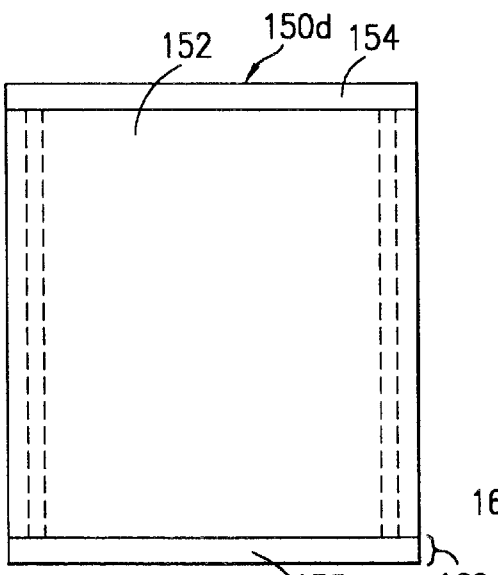
FIG. 8 diagrammatically illustrates an outer base face view with the compressible shim elements mounted laterally on the plastic back-up shear plate.

FIGS. 6, 7 and 9 diagrammatically illustrate compressible shim elements disposed on the flat outer base face of the plastic back-up shear plates. FIGS. 8 and 10 diagrammatically show the location of the compressible shim element on the outer base face. FIGS. 6–10 are discussed concurrently herein.

Back-up shear plate 150 may or may include support ribs 124, 126 shown in FIG. 5. In FIG. 6, back-up shear plate 150 as a flat outer base face 152 and a compressible shim elements 154 rising above outer base face 152. Compressible shim element 154 in FIG. 6 is arcuate in nature and extends from interlocking lateral edge 118 to interlocking lateral edge 116. FIG. 9 shows arcuate compressible shim element 154 without a strut. FIG. 6 shows shim element 154 with a singular, outwardly rising strut 156. FIG. 7 shows outwardly rising strut 156 in addition to two angularly disposed struts 158.

FIG. 8 shows compressible shim elements 154, 155 disposed laterally across back-up shear plate 150. In FIG. 10, arcuate compressible shim elements 154, 155 have a greater longitudinal extent 160 as compared with the longitudinal extent 162 of the arcuate compressible shim shown in FIG. 8.

In operation, compressible shims 154, 155 are utilized to replace one or more of shims 57, 59 diagrammatically illustrated in FIG. 1. Since the plastic back-up shear plate of the present invention is made of plastic and can be easily manufactured and distributed to window frame installers, a selection of back-ups shear plates are available. Some of those back-up shear plates have flat outer base face 112 as shown in FIG. 4 and other back-up shear plates have various compressible shim elements 154, 155 shown in FIGS. 6–10.

Figure 11:
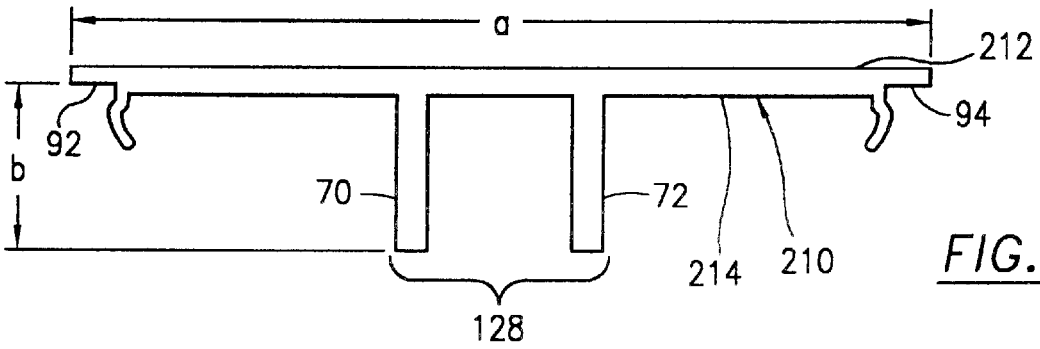
FIG. 11 diagrammatically illustrates a cross-sectional view of another embodiment of the plastic back-up shear plate having support ribs rising above the inner back plate face to support the U-shaped or C-shaped channel on the metal window frame.

FIG. 11 diagrammatically illustrates a plastic back-up shearplate 210 having a flat outer base face 212, a flat inner back plate face 214 and a pair of upstanding ribs 70, 72 which provide a support structure about a longitudinal central run 129 of shear plate 210. The support structure established by upstanding ribs 70, 72 is utilized to support the U-shaped channel 22 shown in FIG. 2 when screw 65 is utilized to mount window frame 10 on column 50. Shear plate 210 also includes laterally disposed opposite outer edge portions 92, 94.

Figure 12:
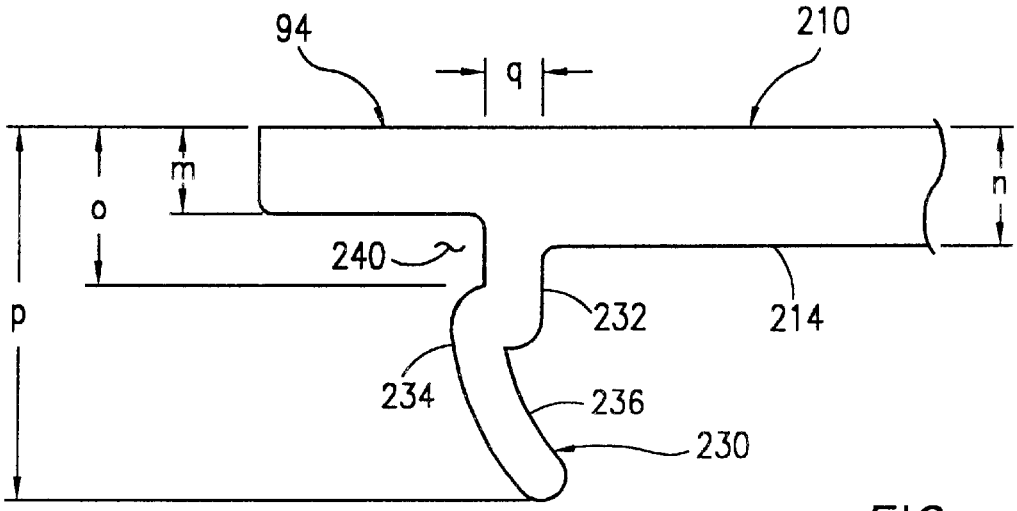
FIG. 12 is an enlarged, cross-sectional end view of an outer edge portion of the plastic back-up shear plate which is interlockable with the outer-wall elements which define the mouth of the metal window frame.

FIG. 12 shows a detailed view of outer edge portion 94 and particularly interlock finger 230. Interlock finger 230 includes a normal or perpendicular base 232, a joint 234 and an angularly disposed stub 236. Normal base member 232 and angularly disposed stub 236 extend inward and rise above inner back plate face 214. The edge of the mouth defining first and second wall segments 38, 40 (FIG. 3) are trapped in region 240.

The following Exemplary Dimension Table provides some general dimensions for the plastic back-up shear plate.

| Exemplary Dimension Table (approximate) (in.) | |
|---|---|
| a | 4 |
| overall length | 2.5–4 |
| b | 0.85 |
| m | 0.1 |
| n | 0.125 |
| o | 0.2 |
| p | 0.8 |
| q | 0.6 |
| r | 0.7 |

Figure 13:
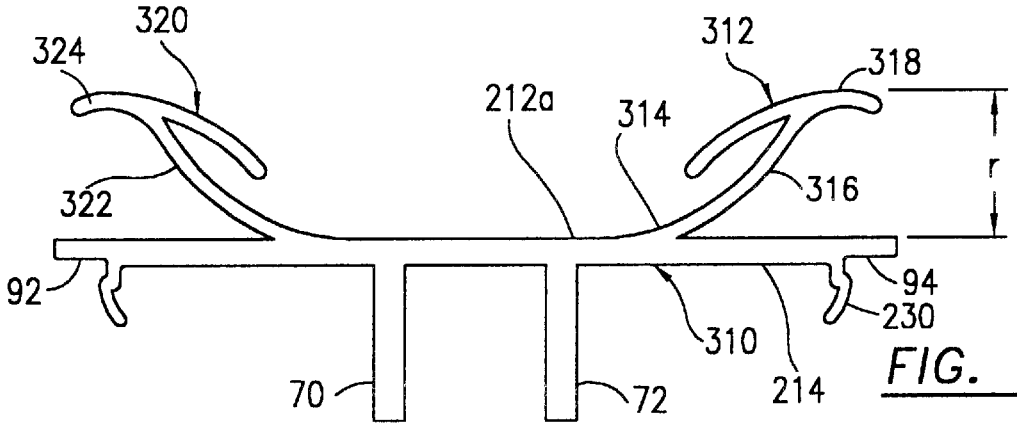
FIGS. 13, 14 and 15 diagrammatically illustrate end views of the plastic back-up shear plate having compressible shim elements as arcuate fingers with finger pads, a detail of one of the finger shims and a detail of the interlockable edge portion of the plastic back-up shear plate.
Figure 14:
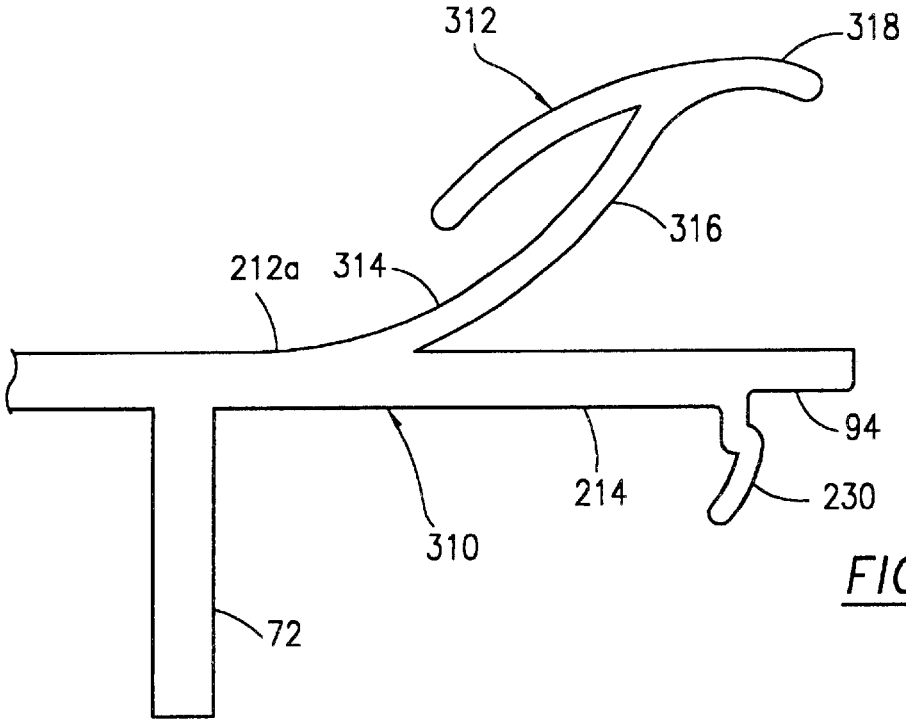
Figure 15:
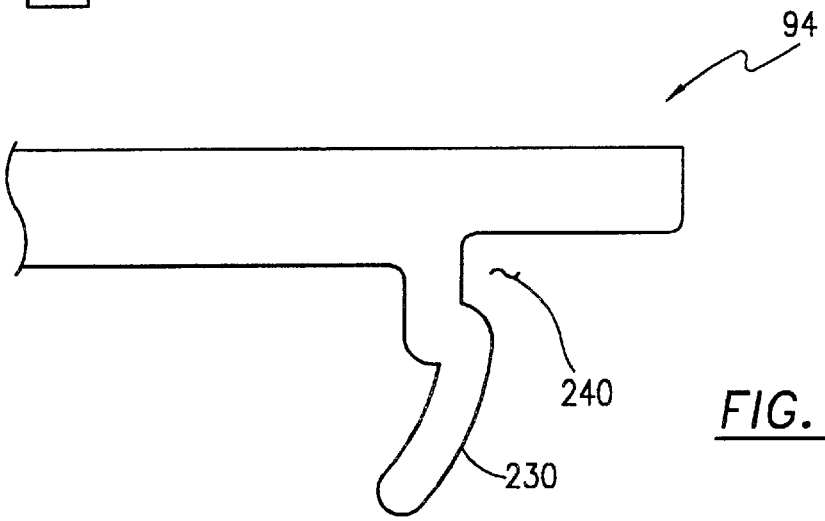

FIGS. 13–15 diagrammatically illustrates other types of compressible shim elements. Plastic back-up shear plate 310 includes a compressible shim element in the form of a resilient finger 312. Resilient finger member 312 includes a base joint 314, a compressible and a resilient body member 316 and a finger pad 318. Compressible finger member 312 has, in this illustrated embodiment, a complementary finger shim member 320. Finger bodies 316 and 322 of fingers 312, 320, in association with outer base face 212 form a concave shim structure. Other types of compressible finger member shapes may be utilized.

Finger pads 312 and 324 are generally convex in shape as compared with finger bodies 316, 322. Other shapes for the finger pads may be utilized. FIGS. 14 and 15 show detailed views of resilient finger shims 312 and interlock edge regions 94.

Figure 16:
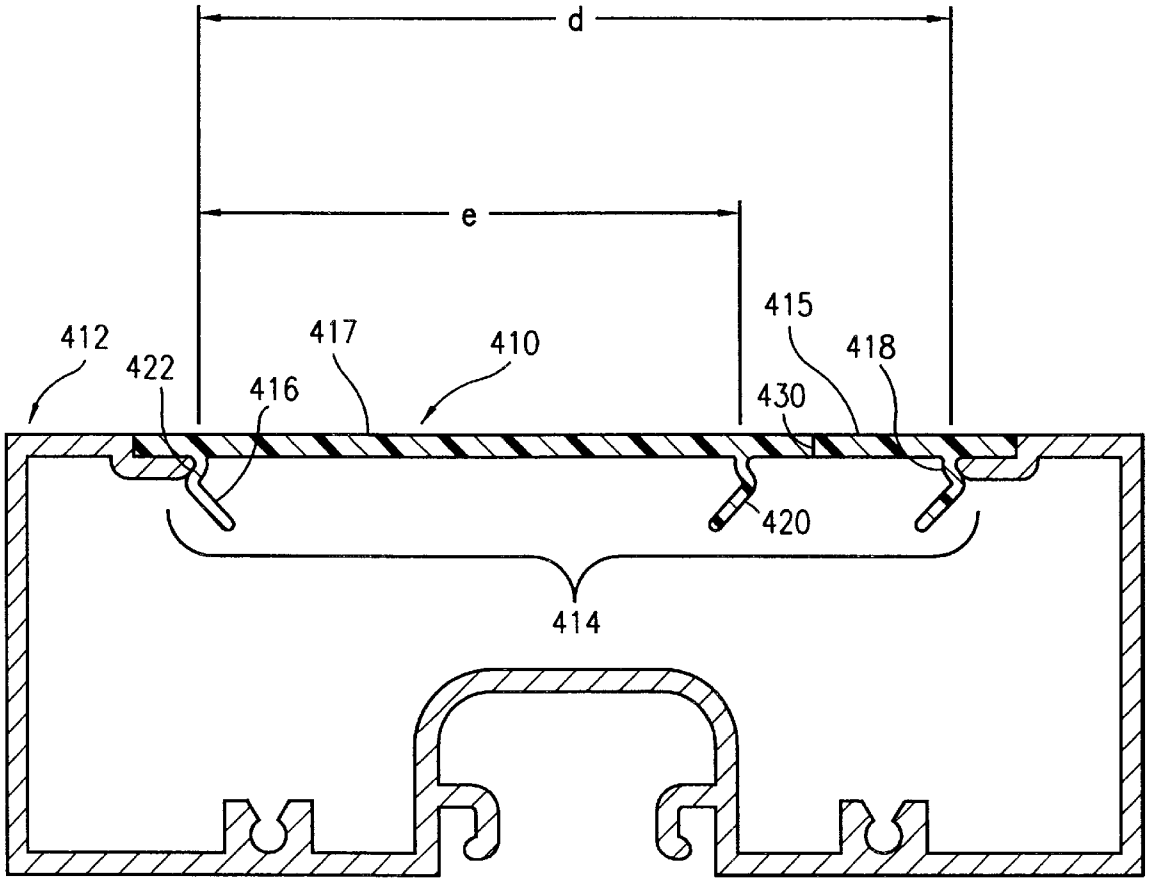
FIG. 16 diagrammatically illustrates a cross-sectional view of a sizable shear plate mounted on a window frame.

FIG. 16 diagrammatically illustrates a cross-sectional view of a sizable shear plate 410 mounted on a large size metal (aluminum) window frame 412. In the illustrated embodiment, frame mouth 414 is 4.5 inches (its lateral expanse). Shear plate 410 has a first lockable edge portion member 418 and an intermediate lockable lip 420 inboard of second lockable edge member 418. Lip 420 and lockable edges members 416, 418 all define outboard facing channels (see channel 422 on lockable edge member 416) which are substantially similar. The distance from lockable edge member 416 to edge member 418 is larger than the distance to intermediate lockable lip 420. Large window frame has mouth 414 with a 4.5 inch lateral expanse d. The sizable shear plate 410 can be cut or broken at inboard demarcation score 430 to (a) shorten the lateral expanse of the shear plate from d to e; and (b) accommodate a 4.0 inch metal frame mouth (lateral expanse e).

Figure 17A:
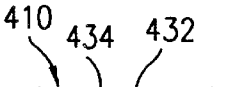
FIGS. 17*a*, 17*b* and 17*c* diagrammatically illustrate cross-sectional and broken-away, perspective views of the sizable shear plate and particularly break-away demarcations for the shear plate.
Figure 17B:
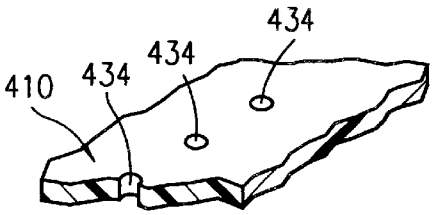
Figure 17C:
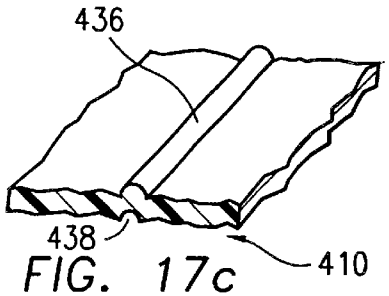

FIG. 17*a* shows score line as a groove or surface channel 432 on outer face 434 of shear plate 410. FIG. 17*b* shows the score line as a series of perforations or holes 434. Alternatively, perforations may not extend through plate 410. FIG. 17*c* shows both a raised surface land 436 and an underlying channel 438. Land 436 is sufficient to identify the score line marking the break-away region 415 (FIG. 16) from foreshortened region 417 of shear plate 410. The channel 432, 438 enhances separability. The score line demarcation is linear.

The shear plate can be sized to fit multiple window frame mouths. Four inch and four and one-half inch frame sizes are common. To modify the sizable shear plate, an inboard oval support 86 (FIG. 3) may be utilized, longitudinal support ribs 124 (FIG. 5) may be utilized and variations of inward support legs 70, 72 (for example, the use of three legs) (FIG. 11) may be utilized in combination with the separable edge portion.

Figure 18B:
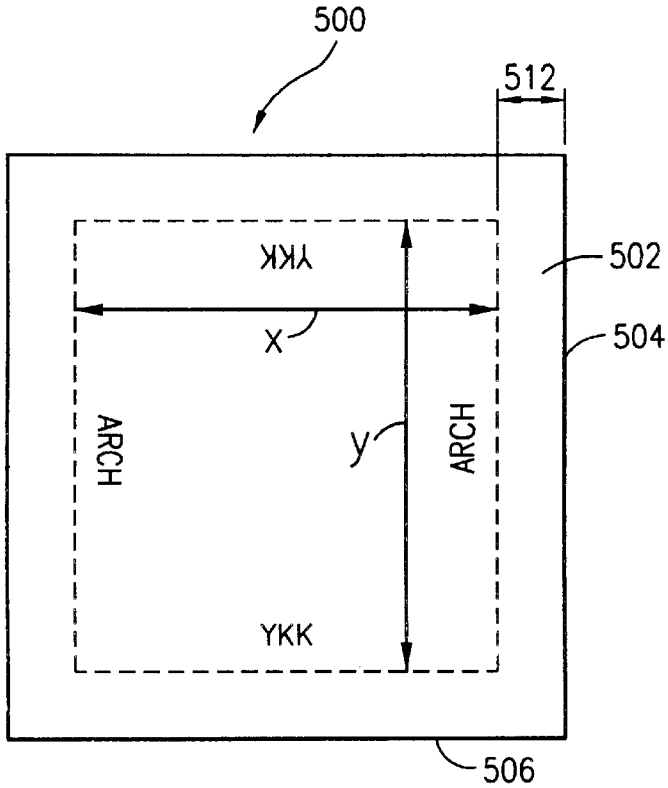
FIG. 18*b* is a top plan view of the shear plate of FIG. 18.
Figure 18A:
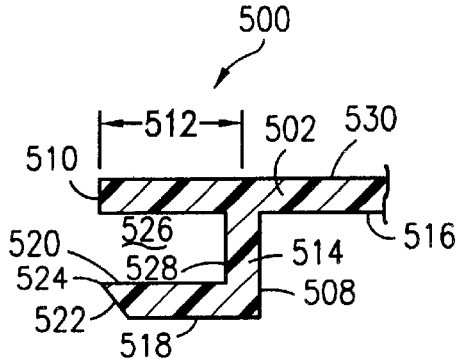
FIG. 18*a* is a sectional view taken along line 18*a*—18*a*.
Figure 18:
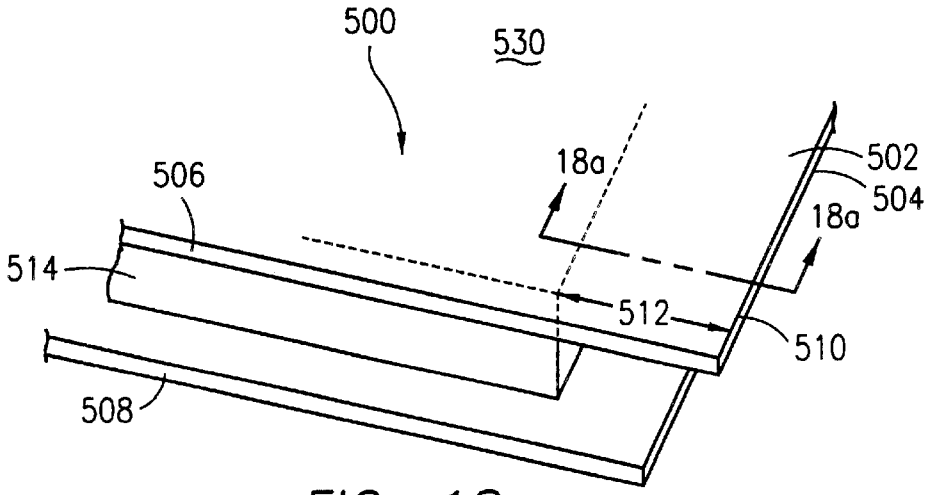
FIG. 18 is perspective view showing a further embodiment of the novel shear plate designed to fit two different window frames, by using different orientations.

Shown in FIGS. 18, 18*a* and 18*b* is a unique design for the shear plate of the present invention. In the supply of window frames there are four major manufacturers. One of them supplies windows having a mouth define between outer wall elements 38, 40 that differs by a small fixed value. For example, the width of the mouth of the window frame of one popular manufacturer may differ by ⅛ inch, or some other small fixed value, from the width of the mouth of the window frame of a second popular manufacturer. In such circumstances, a simple design for a shear plate can be made to accommodate both window frames through the use of the shear plate of the present invention. As shown, the shear plate 500 consists of a flat plastic plate 502 having a length 504 that is larger than its width 506 by a fixed value, e.g. $\frac{1}{8}^{th}$ inch. Molded integrally with the plate 502 is an L-shaped bead 508 that extends peripherally about the perimeter of plate 502 spaced inwardly from its perimeter edge 510 by a distance indicated by the reference numeral 512. Bead 508 consists of a short leg 514 that is integral with the undersurface 516 of plate 502 extending normally, and joined with long leg 518 that extends parallel with undersurface 516 toward the edge of plate 510 terminating in a free end 520 that lies vertically co-extensive with the edge 510. Free end 520, on its underside tapers to define incline or tapered surface 522 and terminal point 524. Defined between the undersurface 516 and long leg 518 is a slot 526 the bottom of which is established by the outer wall 528 of the short leg 514. The plate 500 is constructed and designed such that the distance Y between the bottoms of the slots on one set of opposing sides of the plate is different from the distance X between the bottoms of the slots on the other set other set of opposing sides by a small fixed value, e.g. $\frac{1}{8}^{th}$ inch. On the top surface 530 of the plate 500 different identifying indicia is placed adjacent opposed sides or edges correlated with the distance Y and X. For example, as shown in FIG. 18, the indicia "YKK" is placed on one set of opposed sides to represent one manufacturer, and the indicia "ARCH" is placed on the other set of opposed sides to represent another manufacturer. The indicia may by created during molding and therefore, be embossed, may be printed on the top surface 530 using ink or any suitable colored coating, or may be branded into the surface 530 using a heated branding iron.

In use, the shear plate 500 is appropriately oriented with the aid of the indicia for use with window frames of a particular manufacturer. If the manufacturer is, for instance YKK, the shear plate 500 is oriented so that the slots along the set of opposed edges are placed on the outer wall elements 38, 40 across the mouth as discussed previously, with the edges of the window frame received and interfit in the slots 526. On the other hand, if on a particular job the contractor is using window frames made by ARCH, then the shear plate 500 is oriented so that the set of opposed sides bearing the indicia "ARCH" will engage the window frame elements 38, 40 by the slots 526. Accordingly, the shear plate as described will accommodate the most popular two manufacturers.

Although the present invention is shown and described in terms of specific embodiments, changes and modifications apparent from the teachings of the present invention are deemed to fall within the purview of the invention as set forth in the appended claims.

What is claimed is:

1. A back-up shear plate in combination with two different sized metal window frames, one window frame having a frame mouth opening size of X dimension and the other window frame mouth opening of Y dimension, each frame having an elongated hollow body with inwardly disposed wall elements, front and rear wall elements and outer wall elements, said inwardly disposed wall elements forming an inwardly facing U-shaped channel adapted to retain a window therein, said outer wall elements of both said different sized window frames forming an outwardly facing frame mouth with first and second opposing wall segments on either side of said outwardly facing frame mouth, said mouth spaced apart from said U-shaped window channel, said different sized window frames having either X or Y dimensions for said outwardly facing frame mouth openings, the back-up shear plate comprising:

a laterally disposed rectangular base plate having two sets of opposed sides sized to snap fit in a respective frame mouth of one of said different window frames having different frame mouth openings and spaced apart from said U-shaped window channel, said base plate having laterally disposed first and second lockable, opposite outer edge members defining slots adapted to be interlockable on corresponding opposing outer wall elements which define said respective frame mouth of said X or said Y dimension of said respective different window frames having different frame mouth openings;

said base plate being arranged such that the distance between slots on one set of opposed sides of the base plate is greater than the distance between slots on the other set of opposed sides for engaging with the outer elements defining a corresponding frame mouth of said X or said Y dimension of said respective different window frames.

2. A back up shear plate according to claim 1 made of a plastic material.

3. A back up shear plate according to claim 2 wherein the slots are defined by an L-shaped bead formed integrally with the undersurface of the shear plate.

4. A back up shear plate according to claim 3 wherein the bead extends around the periphery of the shear plate adjacent its edges.

5. A back up shear plate according to claim 1 wherein indicia is present on the top surface of the shear plate distinguishing the two sets of opposed sides.

6. A back up shear plate as claimed in claim 1 wherein said slots are formed of a plurality of tabs coacting with a slot sidewall adapted to capture one or the other of said first and second opposing wall segments on either side of said outwardly facing frame mouth.

7. A back up shear plate as claimed in claim 6 wherein said slot side wall has cut-outs opposite said tabs.

8. A back-up shear plate in combination with a plurality of metal window frames having different sized frame mouth openings, each frame having an elongated hollow body with inwardly disposed wall elements, front and rear wall elements and outerwall elements, said inwardly disposed wall elements forming an inwardly facing U-shaped channel adapted to retain a window therein, said outer wall elements forming an outwardly facing frame mouth with first and second opposing wall segments on either side of said outwardly facing frame mouth, said plurality of different window frames having a corresponding plurality of different sized outwardly facing frame mouth openings, said mouth openings being spaced apart from said U-shaped window channel, the back-up shear plate comprising:

a laterally disposed base plate having a plurality of sides equivalent to twice said plurality of different window frames, each side of said base plate having opposing, outwardly facing slots and each slot on each opposing side adapted to snap into in a respective frame mouth of one of said plurality of different window frames having different frame mouth openings such that said base plate is spaced apart from said U-shaped window channel, said each opposing slot of said base plate having laterally disposed first and second lockable, opposite outer edge members adapted to be interlockable on corresponding opposing outer wall elements which define said respective frame mouth of one of said different window frames having different frame mouth openings;

said base plate being arranged such that the distance between opposing slots on opposing sides of the base plate is substantially equivalent to a respective one of said different sized outwardly facing frame mouth opening of one of said plurality of different window frames, and respective distances between opposing slots for the plurality of opposing sides is substantially equivalent to corresponding different sized outwardly facing framemouth openings of corresponding ones of said plurality of different window frames.

9. A back up shear plate according to claim 8 made of a plastic material.

10. A back up shear plate according to claim 9 wherein the slots are defined by an L-shaped bead formed integrally with the undersurface of the shear plate.

11. A back up shear plate according to claim 10 wherein the bead extends around the periphery of the shear plate adjacent its edges.

12. A back up shear plate according to claim 11 wherein indicia is present on the top surface of the shear plate distinguishing sets of opposed sides.

13. A shim plate in combination with a metal window frame, said window frame having an elongated hollow body with inwardly disposed wall elements, front and rear wall elements and outer wall elements, said inwardly disposed wall elements forming an inwardly facing U-shaped channel adapted to retain a window therein, said outer wall elements forming an outwardly facing frame mouth with first and second opposing wall segments on either side of said outwardly facing frame mouth, said outwardly facing mouth spaced apart from said U-shaped window channel, the shim plate comprising:

a laterally disposed base plate having opposed sides adapted to snap into said frame mouth of said window frame, said base plate having laterally disposed lockable, opposite outer edge members defining slots adapted to be interlockable on corresponding opposing outer wall elements which define said frame mouth and to be spaced apart form said U-shaped window channel;

said base plate having a central cut-out thereat, said central cut-out having a lateral open span distance; and, a ribbon of flexible material laterally disposed across said central cut-out, said ribbon having a length greater than said open span distance and said ribbon at least buckling outboard of said cut-out and adapted to buckle outboard of said frame mouth.

14. A shim plate as claimed in claim 13 wherein said base plate and ribbon are made of plastic.

15. A shim plate as claimed in claim 13 wherein said base plate is a rectangle, the base plate has a lateral span between opposing slots substantially equivalent to one of two frame mouth spans, said opposing slots of said shim plate being a first pair of opposing slots and said lateral span being a first lateral span of said base plate for said one of two frame mouth spans, said base plate having a second pair of opposing slots for a second lateral span of said base plate, said second lateral span of said base plate being substantially equivalent to another of said two frame mouth spans, said one and another of said frame mouth spans being associated with different metal window frames having different sized frame mouth openings; said base plate including first and second ribbons respectively spanning, in a buckled manner, said first and second lateral spans.

* * * * *